US006036567A

United States Patent [19]

Watkins

[11] Patent Number: 6,036,567

[45] Date of Patent: Mar. 14, 2000

[54] PROCESS FOR ALIGNING AND SEALING COMPONENTS IN A DISPLAY DEVICE

[75] Inventor: Charles M. Watkins, Eagle, Id.

[73] Assignee: Micron Technology, Inc., Boise, Id.

[ * ] Notice: This patent is subject to a terminal disclaimer.

[21] Appl. No.: 09/033,256

[22] Filed: Mar. 2, 1998

Related U.S. Application Data

[63] Continuation-in-part of application No. 08/576,672, Dec. 21, 1995, Pat. No. 5,807,154.

[51] Int. Cl.[7] ..... H01J 9/26

[52] U.S. Cl. ..... 445/25

[58] Field of Search ..... 445/24, 25

[56] References Cited

U.S. PATENT DOCUMENTS

| | | | |
|---|---|---|---|
| 4,005,920 | 2/1977 | Wimmer | 316/19 |
| 4,031,597 | 6/1977 | Nubani et al. | 29/25.16 |
| 4,245,273 | 1/1981 | Feinberg et al. | 361/382 |
| 4,277,275 | 7/1981 | Kawamura et al. | 65/43 |
| 4,407,658 | 10/1983 | Bemot | 445/25 |
| 4,417,296 | 11/1983 | Schelhorn | 361/386 |
| 4,665,468 | 5/1987 | Dohya | 361/414 |
| 4,709,122 | 11/1987 | Samuels | 174/52 |
| 4,795,670 | 1/1989 | Nishigaki et al. | 428/209 |
| 5,157,304 | 10/1992 | Kane et al. | 313/495 |
| 5,205,770 | 4/1993 | Lowrey et al. | 445/24 |
| 5,210,472 | 5/1993 | Casper et al. | 315/349 |
| 5,229,331 | 7/1993 | Doan et al. | 437/228 |
| 5,302,328 | 4/1994 | Roe et al. | 156/643 |
| 5,329,207 | 7/1994 | Cathey et al. | 315/169.1 |
| 5,391,259 | 2/1995 | Cathey et al. | 156/643 |
| 5,519,332 | 5/1996 | Wood et al. | 324/755 |
| 5,689,151 | 11/1997 | Wallace et al. | 313/495 |
| 5,697,825 | 12/1997 | Dynka et al. | 445/25 |
| 5,807,154 | 9/1998 | Watkins | 445/25 |

FOREIGN PATENT DOCUMENTS

| | | | |
|---|---|---|---|
| 2076479 | 10/1971 | France . | |
| 53-141572 | 12/1978 | Japan | 445/25 |
| 61-250922 | 11/1986 | Japan . | |
| 2-129828 | 5/1990 | Japan | 445/44 |
| 1037609 | 7/1966 | United Kingdom . | |
| 1482696 | 8/1977 | United Kingdom . | |
| 1533395 | 11/1978 | United Kingdom | 445/25 |

OTHER PUBLICATIONS

Liu, D. et al., "Characterization of Gated Silicon Field Emission Micro Triodes", Sixth International Vacuum Microelectronics Conference, IEEE, Electron Devices Society, Technical Digest, Jul., 1993, pp. 52, 53.

Leppo, Marion et al., *Electronic Materials Handbook*, vol. 1 Packaging, 1989, pp. 203–205.

Kishino, Takao et al., "Present Status of the FED Development and Problems to Solve", Technical Paper, IVMC, Futaba Corporation, Japan, 1995.

Meyer, R., "6" Diagonal Microtips Fluorescent Display for T.V. Applications, LETI/DOPT CENG, Euro display 1990, pp. 374–377.

Vaudaine, R., "'Microtips' Fluorescent Display", IEDM, 1991.

Glass Panel Alignment and Sealing for Flat Panel Displays, Sandia National Laboratory, Colorado, Program Summary, Dec. 1994.

Zimmerman, Steven et al., Flat Panel Display Project Presentation, Sandia National Laboratories, Technical Information Exchange Workshop, Nov. 30, 1994.

Tummala, Rao R., *Microelectronics Packaging Handbook*, pp. 736–755, 1989.

Cathey, David A. Jr., "Field Emission Displays", VLSI, Taiwan, May–Jun., 1995.

*Primary Examiner*—Kenneth J Ramsey
*Attorney, Agent, or Firm*—Hale and Dorr LLP

[57] ABSTRACT

A method for aligning and sealing two plates in a field emission display (FED) is performed in two steps, with a first aligning step being done at atmospheric conditions and using an adhesive to hold the alignment, with a next step of sealing the device, typically in an oven under heated vacuum conditions.

25 Claims, 1 Drawing Sheet

PROCESS FOR ALIGNING AND SEALING COMPONENTS IN A DISPLAY DEVICE

CROSS-REFERENCE TO RELATED APPLICATION

This application is a continuation in part of Ser. No. 08/576,672, filed Dec. 21, 1995 now U.S. Pat. No. 5,807, 154, which is expressly incorporated herein by reference for all purposes.

BACKGROUND OF THE INVENTION

This invention relates generally to methods of manufacturing flat panel displays, and more particularly to methods of manufacturing field emission displays.

A field emission display (FED) is a flat panel display that has a transparent faceplate with phosphor coated pixels, and a cathode having a large number of microtip emitters that can be activated to emit electrons to excite the phosphors. The cathode can be attached to or integrally formed with a backplate; alternatively, the cathode can be attached to the faceplate and enclosed by a backplate assembly sealed to the faceplate. In either case, the cathode must be aligned carefully with the faceplate so that the cathode emitters are disposed across from the specific pixels they are supposed to activate. The alignment must be very fine, e.g., 6–8 microns for a 12 inch (30 cm) display, which is on the order of one part in $10^5$. Because the display must operate in a vacuum, a vacuum seal is made between the backplate and the faceplate. Aligning and maintaining alignment while making a vacuum seal in a high resolution, large area display is a serious problem.

Some types of display devices, such as plasma displays, do not require particularly accurate alignment. It is much easier to seal a display device without the need for careful alignment. For high accuracy alignment applications, it has also been proposed that the alignment and sealing be done simultaneously in a vacuum chamber. Such a process, however, would likely be time-consuming and unsuitable for large-scale manufacture because the aligning and sealing would both have to be done one assembly at a time.

SUMMARY OF THE INVENTION

According to one aspect of the present invention, a flat panel display is made by providing an adhesive between a faceplate and a backplate assembly, aligning the faceplate and backplate assembly so that they are held together in a desired alignment with the adhesive, and bringing together the faceplate and the backplate assembly so that the faceplate and backplate assembly are vacuum sealed.

In preferred embodiments, the method includes heating a sealing material to a temperature sufficient to seal. The adhesive is preferably indium and is pre-treated by firing it above its melting temperature in a vacuum to reduce or remove contaminants. To keep the plates in alignment when the sealing is performed, the adhesive is preferably provided as a cover around a core material that has a much higher softening temperature than the adhesive. As the assembly is heated and the indium melts, this inner core will retain its basic size and shape. This core should be about the same or slightly larger in height than the layer of sealing material used to seal the plates together, and is preferably made of the same material as the sealing material. The backplate assembly can include an integral cathode; alternatively, the faceplate and backplate assembly can surround a cathode connected to the faceplate.

The present invention also includes an assembly in the manufacture of a display device. The assembly has a faceplate and backplate, with an adhesive holding the two in alignment and a sealing material for forming a hermetic (preferably vacuum) seal. The adhesive is preferably indium and is preferably formed as a cover around a core. The core is preferably made from the same material as the sealing material. The indium will serve as an adhesive at room temperature and at one atmosphere.

The present invention allows the aligning and sealing to be performed in at least two stages. The aligning can be performed in a first stage at one atmosphere and at room temperature, and the sealing can be performed in a vacuum oven in a second stage. While the aligning of assemblies would typically be performed one assembly at a time because of the aligning requirements, the sealing can be performed on groups of assemblies at one time in a vacuum oven. The present invention thus allows aligning with very high resolution (up to one part in $10^5$) under room conditions, and then vacuum sealing in numbers, thereby improving manufacturing compared to aligning and sealing one at a time. Other features and advantages will become apparent from the following detailed descriptions, drawings and claims.

DETAILED DESCRIPTION

Figure 1:
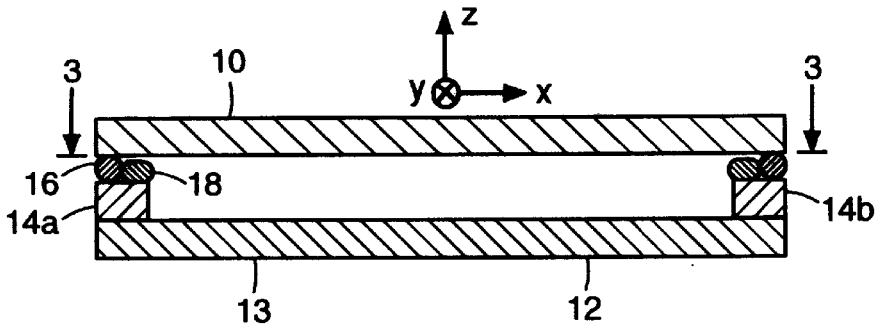
FIGS. 1 and 2 are part cross-sectional, part side views illustrating a method and apparatus according to the present invention.

Referring to FIG. 1, an FED assembly has a faceplate 10 and a cathode member 12. Cathode member 12 is formed integrally on a plate portion 13 of a backplate assembly, as is known. The backplate assembly with integral cathode member 12 may be spaced from faceplate 10 by a spacer ring represented as spacers 14*a*, 14*b*, which are made of a glass similar to a glass used in the formation of plate portion 13 of the backplate assembly. Faceplate 10 has a substrate that is also preferably made of glass. Acceptable glasses for faceplate 10, plate portion 13, and spacers 14*a*, 14*b* include Corning 7059, 1737, and soda-lime silica. In an FED, the faceplate would also typically have a transparent conductive layer, such as indium tin oxide (ITO), over a transparent glass substrate, phosphor particles on the conductive layer, and a grille made of a black matrix to separate and define the pixel regions. Such a structure is generally known.

According to the present invention, the FED is assembled by providing an adhesive 16 on one of faceplate 10 and cathode member 12 and aligning faceplate 10 and cathode member 12 relative to each other in the xy-plane. When aligned and brought together along the z-axis, adhesive 16 holds the faceplate and backplate assembly together in alignment. This alignment can be performed at one atmosphere, i.e., in ambient pressure conditions, and (with an appropriate adhesive) at room temperature. The aligning is very precise—on the order of 1 part in $10^5$—and can be performed with known high precision alignment techniques (e.g., techniques that use alignment cross-hairs).

A sealing material 18, preferably a frit material, is provided between faceplate 10 and cathode member 12. Faceplate 10 and cathode member 12 are further brought together to fix them together with adhesive 18 to create a hermetic seal. This bringing together is preferably done in a vacuum to create a vacuum seal, and includes heating to a sufficient temperature to melt the sealing material. Bringing these plates together along the z-axis should be done carefully to avoid movement in the xy-plane.

Figure 2:
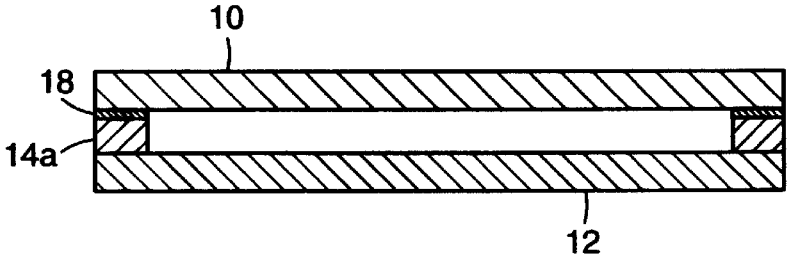
Figure 3:
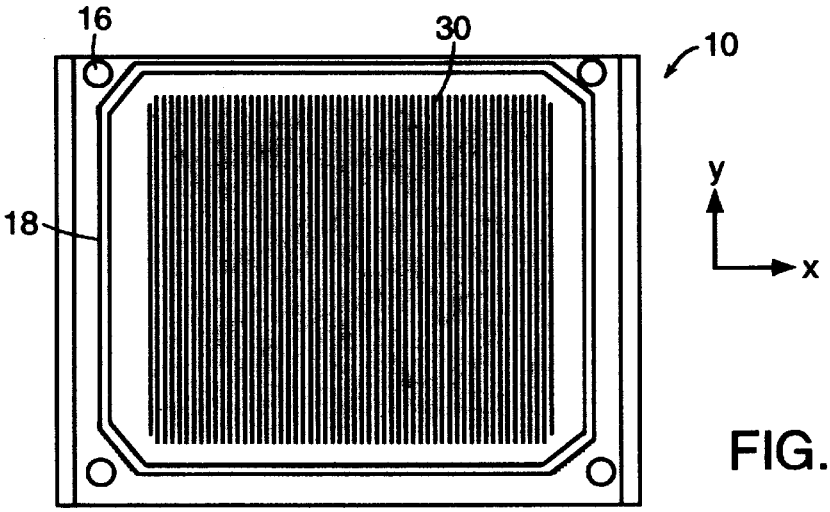
FIG. 3 is a view taken through lines 3—3 in FIG. 1.

Referring also to FIG. 3, in one embodiment, adhesive 16 is formed in balls and is provided at selected discrete locations, e.g., at the four corners of faceplate 10. Sealing material 18 can also be formed in discrete locations, but is preferably formed in a continuous strip without enclosing adhesive 16 as shown to assure a good seal and to help prevent the adhesive from getting on the faceplate. Adhesive 16 is preferably provided in balls that have more height than the layer of sealing material 18 (the height dimension being along the z-axis, i.e., in a direction orthogonal to a plane of the faceplate or a plane of the plate portion of the backplate assembly). During heating, adhesive 16 melts between faceplate 10 and cathode member 12, thereby reducing the height of the adhesive balls to a reduced level that is about the same or slightly less in height than frit 18 so that frit 18 contacts faceplate 10 (see FIG. 2) and seals faceplate 10 to the backplate assembly and cathode member 12.

The adhesive can be selected so that the bringing together is done by pressing to cause a cold solder joint to form between faceplate 10 and cathode member 12. Acceptable adhesives which form a cold solder joint include, for example, indium, lead, tin, silver, cadmium, and compounds and alloys thereof. Some such materials should be heated in order to become wet to glass, but at least indium can be used at room temperature.

According to another embodiment, adhesive 16 can be removed from, and hence its height lowered, between faceplate 10 and cathode member 12 by reduction. In this case, adhesive 16 is an organic material, and the removal comprises oxidation of the organic material. Acceptable organic adhesive include corn protein (such as Zein), polyvinyl alcohol, acryloid material (such as Rolm & Haas B66 and B720).

The adhesive can be pretreated by firing it above its melting temperature in a vacuum to remove contaminants and inclusions, such as bubbles of a contaminant. For indium, a desirable adhesive for this application, the melting temperature is 156° C. When pre-heated at about 185° C. at a vacuum level below $10^{-3}$T, residual gas analysis (RGA) data shows a "burp," i.e., the composition changes as impurities are driven off. Preferably, the adhesive is fired for more than 30 minutes (although it could be for less time) at $10^{-7}$T and 200° C.

Figure 4:
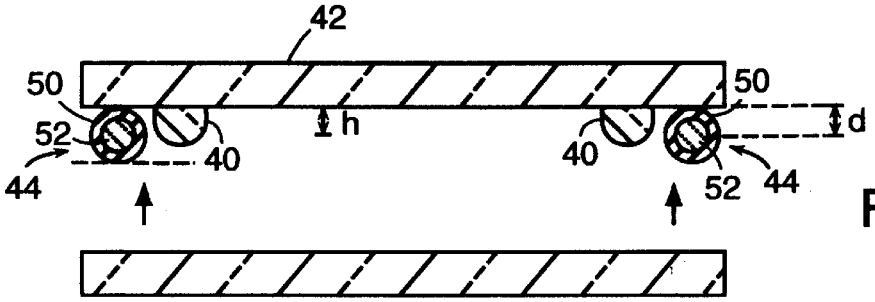
FIG. 4 is a cross-sectional view illustrating the use of adhesive having a core made of a material with a higher melting temperature.

Referring to FIG. 4, a layer of frit sealing material 40 and adhesive balls 44 are formed on a faceplate 42. Adhesive balls 44 have an adhesive cover 50 surrounding a core 52. The core is made of a material that is different from the adhesive material and that has a higher melting point than the adhesive material. The melting point of the material used to make the core is preferably similar to that of the sealing material. For example, if the sealing material is frit and the adhesive is indium, the indium melts at a much lower temperature than the frit (e.g., about 156° C. for indium versus 300° C. to 400° C. depending on the specific frit). By providing adhesive balls with cores of frit, the adhesive balls retain their general shape. The core provides some spacing to reduce the likelihood that one area of the adhesive will melt much more quickly than another due to inconsistent heating of the adhesive and thereby cause the faceplate and backplate assembly to come out of parallel alignment by moving in the plane of the faceplate.

In this embodiment, the frit spheres should have a diameter d that is about equal to, or preferably slightly larger than, a height h of the layer of sealing material so that the adhesive essentially retains its height and there is less variation in the height as the balls of adhesive are heated.

In each of these embodiments, the aligning can be, and preferably is, performed at ambient atmospheric conditions, while the sealing is preferably done in a vacuum oven many at a time. This multi-step approach is more desirable than a single step approach in which aligning and sealing are both done in a vacuum environment, because the aligning step requires precision, while the heating can be done on larger numbers of assemblies held together with adhesive after each device has been aligned. Accordingly, the aligning is preferably done on one assembly at a time at about one atmosphere and preferably at room temperature, while the sealing step is preferably performed in batches in heated vacuum conditions.

Having described certain embodiments of the present invention, it should be apparent that modifications can be made without departing from the scope of the invention as defined by the appended claims. For example, the cathode members may have no additional spacer ring and may be spaced from the faceplate by the thickness of the sealing material put on the faceplate or backplate. The vacuum may be drawn after sealing by providing an access tube, pulling a vacuum, and pinching off the tube as is done in CRT manufacturing.

What is claimed is:

1. A method for assembling a display device comprising:

providing an adhesive on one of a faceplate and a backplate assembly of a flat panel display device;

providing on one of the faceplate and the backplate assembly a layer of a sealing material suitable for forming a vacuum seal;

in ambient pressure conditions, aligning the faceplate and the backplate assembly and bringing the faceplate and backplate assembly together so that the faceplate and backplate assembly are aligned and held together with the adhesive;

in a vacuum environment, after the aligning, bringing together the faceplate and backplate assembly so that the sealing material forms a vacuum seal between the faceplate and the backplate assembly and so that the faceplate and backplate assembly enclose an interior vacuum region.

2. The method of claim 1, further comprising providing a plurality of adhesive regions at discrete locations on one of the faceplate and backplate assembly.

3. The method of claim 1, wherein providing an adhesive includes providing an adhesive ball that has an adhesive material as a cover around a core, the core being made of a material different from the adhesive material and having a higher melting point than that of the adhesive material.

4. The method of claim 3, wherein providing an adhesive includes providing an adhesive material on a spacer between the backplate assembly and the faceplate.

5. The method of claim 3, wherein providing an adhesive includes providing an adhesive material as a cover around a core that is made of the same material as the sealing material.

6. The method of claim 1, wherein providing an adhesive includes providing indium on one of the faceplate and backplate assembly.

7. The method of claim 6, further comprising pre-heating the indium above the melting point of indium to remove contaminants.

8. The method of claim 1, wherein the aligning includes aligning at room temperature.

9. The method of claim 1, wherein aligning the faceplate and backplate assembly includes aligning the faceplate with a backplate assembly that has an integral cathode member.

10. The method of claim 9, wherein the display device is a field emission display, the faceplate including pixel regions, the cathode member including a large number of electron emitters.

11. A method for assembling a display device comprising:

providing an adhesive ball on one of a faceplate and a backplate assembly, the adhesive ball having an adhesive cover around a core;

providing a layer of a sealing material suitable for forming a hermetic seal on one of the faceplate and the backplate assembly, the sealing material being made of the same material as the core;

aligning the faceplate and the backplate assembly and bringing the faceplate and backplate assembly together so that the faceplate and backplate assembly are parallel and held together with the adhesive;

heating the held-together faceplate and backplate assembly to a sufficient temperature so that the sealing material forms a hermetic seal between the faceplate and the backplate assembly.

12. The method of claim 11, wherein the aligning is done at about one atmosphere and at room temperature, while the heating is done in a vacuum oven to form a vacuum seal.

13. The method of claim 11, further comprising a step of heating the adhesive above its melting point to remove contaminants.

14. The method of claim 11, wherein providing an adhesive ball includes providing a ball that has more height than the layer of sealing material.

15. An assembly in the manufacture of a flat panel display device, the assembly comprising:

a transparent faceplate;

a backplate assembly including a plate portion parallel to the faceplate;

a layer of sealing material suitable for forming a hermetic seal on one of the faceplate and the backplate assembly;

an adhesive region in contact with both the faceplate and the backplate assembly, the adhesive region being larger in dimension than the layer of sealing material along a direction perpendicular to the faceplate and the backplate assembly, the adhesive region holding the faceplate and backplate assembly together while aligned but prior to being sealed together.

16. The assembly of claim 15, wherein the adhesive includes an adhesive material around a core, the core being made of a material having a melting point higher than the melting point of the adhesive material.

17. The assembly of claim 16, wherein the melting point of the core is about the same as the melting point of the sealing material.

18. The assembly of claim 16, wherein the core is made of the same material as the sealing material.

19. The assembly of claim 16, wherein the core has a height and the sealing material is provided with a height, wherein the height of the core is greater than the height of the sealing material.

20. The assembly of claim 15, wherein the backplate assembly includes a spacer layer.

21. The assembly of claim 15, wherein the backplate assembly has an integral cathode formed thereon.

22. The assembly of claim 15 wherein the backplate assembly has a spacer layer and a plate portion, the backplate assembly further including a cathode parallel to the plate portion and the faceplate.

23. An assembly in the manufacture of a display device, the assembly comprising:

a transparent faceplate;

a backplate assembly including a plate portion parallel to the faceplate;

a layer of sealing material suitable for forming a hermetic seal on one of the faceplate and the backplate assembly;

an adhesive ball in contact with both the faceplate and the backplate assembly, the adhesive ball having an adhesive cover around a core, the core being made of a material with a higher melting point than that of the adhesive cover, the adhesive region holding the faceplate and backplate assembly together while aligned but prior to their being sealed together.

24. The assembly of claim 23, wherein the core is made of the same material as the sealing material.

25. The assembly of claim 23, wherein the cover is made of indium.

* * * * *